United States Patent [19]

Parkinson

[11] 4,264,797

[45] Apr. 28, 1981

[54] ELONGATED KEY MEMBRANE SWITCH

[75] Inventor: Wayne K. Parkinson, Mequon, Wis.

[73] Assignee: W. H. Brady Co., Milwaukee, Wis.

[21] Appl. No.: 113,461

[22] Filed: Jan. 21, 1980

[51] Int. Cl.[3] ..... H01H 13/70

[52] U.S. Cl. ..... 200/159 B; 200/5 A

[58] Field of Search ..... 200/5 A, 5 R, 159 A, 200/159 B, 159 R, 340, 310, 313, 314; 74/483 PB, 10.1

[56] References Cited

U.S. PATENT DOCUMENTS

| | | | |
|---|---|---|---|
| 3,665,126 | 5/1972 | Gabor | 74/483 PB |
| 4,145,584 | 3/1979 | Otterlei | 200/5 A |

FOREIGN PATENT DOCUMENTS

| | | | |
|---|---|---|---|
| 2523514 | 12/1975 | Fed. Rep. of Germany | 200/159 B |
| 2833304 | 2/1979 | Fed. Rep. of Germany | 200/159 B |

*Primary Examiner*—John W. Shepperd

[57] ABSTRACT

A multi-layered membrane switch having a spacer layer with one or more tabs extending across the width of its cut out portion to provide support for an upper contact supporting layer.

5 Claims, 2 Drawing Figures

FIG 1
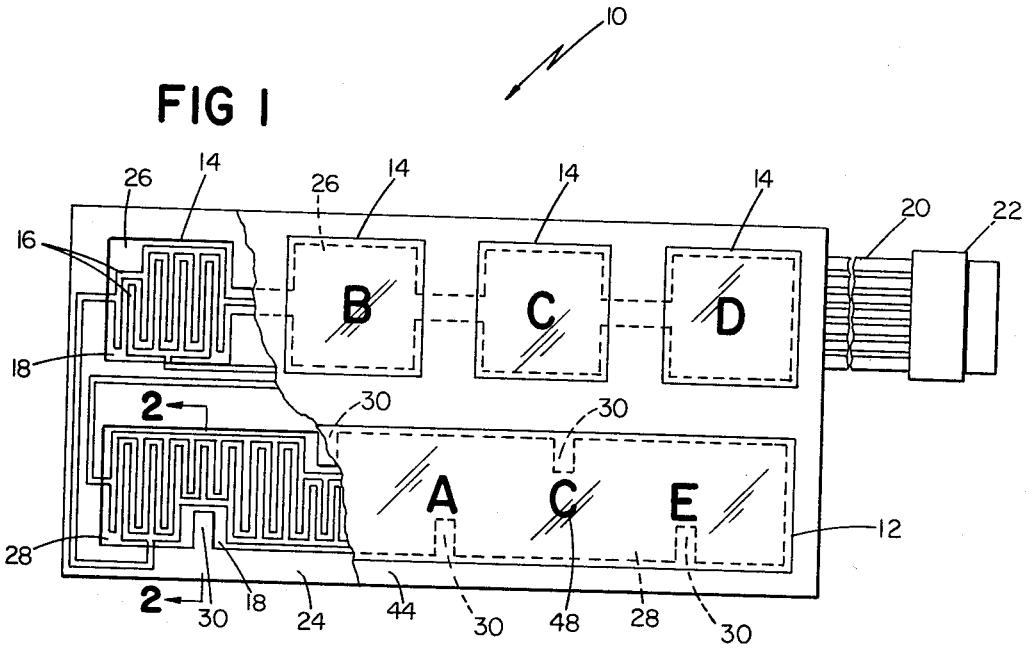
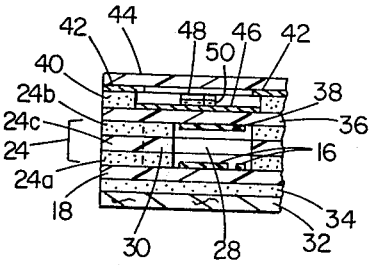
FIG 2

ELONGATED KEY MEMBRANE SWITCH

FIELD OF THE INVENTION

This invention relates to multi-layered flexible membrane switches having generally long and narrow switch contact areas.

BACKGROUND OF THE INVENTION

In producing membrane keyboards, problems have been observed with switches (such as typewriter space bars) having contact areas with a length to width ratio greater than one; the upper contact supporting layer may sag near the center of the switch contact area, thereby causing an increase in sensitivity or possibly a permanently closed switch.

SUMMARY OF THE INVENTION

I have discovered that by adding one or more small tabs in the cut-out portion of contact spacer layers of narrow switches, improved support can be easily and cheaply provided for the upper contact supporting layer without significantly affecting the sensitivity or the effective area of activation. In preferred embodiments the length to width ratio of the contact portions is at least 2:1; the tab extends less than half-way across the width of the spacer cut out portion; the tabs are alternately located along opposite sides; and the distance along the length between adjacent tabs is equal to or greater than the width.

PREFERRED EMBODIMENT

I turn now to description of the drawings and the structure and operation of the preferred embodiment.

DRAWINGS

FIG. 1 is a plan view, partially broken away and somewhat diagrammatic, of a membrane switch according to the invention.

FIG. 2 is a partial sectional view therethrough, taken at 2—2 of FIG. 1.

STRUCTURE

There is shown in FIG. 1 a membrane switch 10 having a generally rectangular switch contact area 12 and four square switch contact areas 14. Conductive ink patterns 16 are located on lower contact support layer 18, which extends at one end to tail 20 having connector 22. Located on top of layer 18 is spacer layer 24 having cut out portions 26 above square switch contact areas 14 and cut out portions 28 above generally rectangular switch contact area 12, portion 28 having tabs 30 extending across the width of the remainder of portion 28 a distance of one-third that width, alternately located on opposite sides of portion 28, and spaced distances equal to the widest width of portion 28.

As is shown in detail in FIG. 2, in the final assembly switch 10 includes release sheet 32, layer of adhesive 34, plastic lower contact support layer 18 bearing conductive ink switching portions 16, spacers 24 (made of adhesive layers 24*a* and 24*b* and polyester layer 24*c*), upper plastic contact support layer 36 bearing shorting conductive ink contact 38, adhesive layer 40, opaque ink layers 42 and velvet polycarbonate overlay layer 44. The adhesive 40 and ink 42 are carried by polycarbonate layer 44. Carried on the upper surface of layer 36 is a layer of white ink 46 and index letter 48, which is adhered thereto by adhesive 50. In this instance, index 48 is the letter S, which along with the other letters spell the word "space".

OPERATION

In operation switch 10 is mounted on a support surface after removal of release sheet 32, and it is then connected to external circuitry via connector 22. When any of the switch areas 12, 14 are manually depressed, shorting contact 38 will contact contacts 16, thereby providing a closed circuit for the particular area depressed. Because spacer layer 24 has tabs 30, upper contact supporting layer 36 is adequately supported along its length in switch contact area 12.

What is claimed is:

1. A multi-layered flexible membrane switch comprising a lower contact supporting layer having a first electrical contact on its upper surface, an upper contact supporting layer located thereabove having a second electrical contact on its lower surface, and a spacer layer located between said upper and lower layers and having a cut out portion with a length to width ratio greater than one, said spacer layer having at least one tab partially extending from one of the longer sides of said portion into the width of said portion.

2. The switch of claim 1 in which said length to width ratio is at least two.

3. The switch of claim 2 wherein each said tab extends less than half-way across said width.

4. The switch of claim 3 wherein said layer has more than one tab, said tabs being alternately located along opposite longer sides of said portion.

5. The switch of claim 4 wherein the centerline to centerline distances along said length between tabs are equal to or greater than said width.

* * * * *